United States Patent [19]

Pasquini

[11] 4,331,082

[45] May 25, 1982

[54] RAILWAY TRACK TAMPER

[75] Inventor: Sandro Pasquini, La Tour-de-Peilz, Switzerland

[73] Assignee: SIG Societe Industrielle Suisse Industrieplatz, Neuhausen-Chutes du Rhin, Switzerland

[21] Appl. No.: 117,370

[22] Filed: Jan. 31, 1980

[30] Foreign Application Priority Data

Feb. 23, 1979 [CH] Switzerland ..... 1803/79

[51] Int. Cl.[3] ..... E01B 27/17

[52] U.S. Cl. ..... 104/12

[58] Field of Search ..... 104/7 R, 8, 12

[56] References Cited

U.S. PATENT DOCUMENTS

| | | | |
|---|---|---|---|
| 4,066,020 | 1/1978 | Theurer | 104/12 |
| 4,088,077 | 5/1978 | Beckmann | 104/12 |
| 4,103,622 | 8/1978 | Theurer | 104/12 |
| 4,165,693 | 8/1979 | Theurer | 104/12 |

*Primary Examiner*—Richard A. Bertsch

*Attorney, Agent, or Firm*—Anthony J. Casella

[57] ABSTRACT

Tamper whose rolling chassis (34) comprises, arranged between two trucks (35 and 36), tools for tamping (31) and displacement (32) of the track (3) as well as a power plant (37) which are fastened below a bridge-shaped part (33-330) of this chassis.

On the front of this tamper there is installed a cab (26) which is extended to above the tools and in which there are combined a control station (25) for these tools which provides a view of them through a window (29), two driving stations (27, 270), a station for the setting and posting (28) of the prescribed values of the displacements of the track obtained at the level of the displacement tools (32), and a station (40) for verification of the actual displacements of the track obtained after tamping.

On the rear of this tamper, arranged as a loading platform (38), there is carried, during the travel to the work a truck (39) for measuring said actual displacements.

6 Claims, 6 Drawing Figures

FIG. -1- PRIOR ART
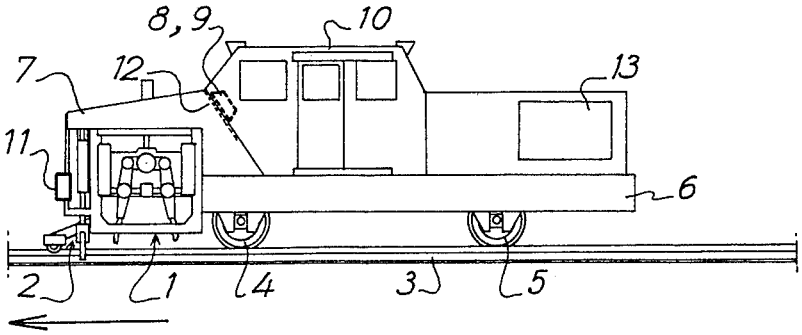
FIG. -2- PRIOR ART
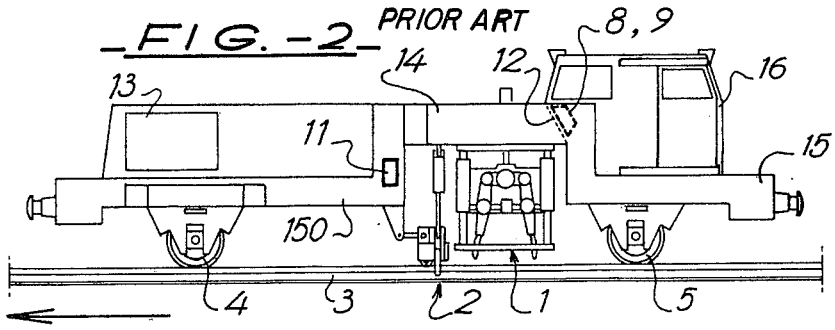
FIG. -3- PRIOR ART
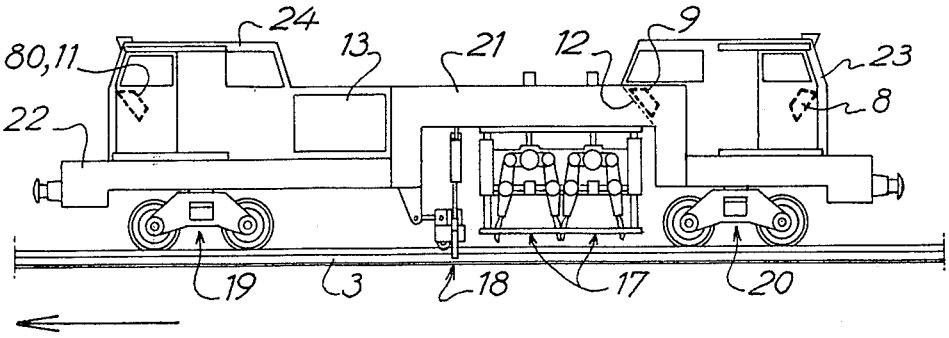

RAILWAY TRACK TAMPER

The object of the present invention is a tamper for railway tracks of the type set forth hereafter which during its advance simultaneously assures the tamping of the track and the correcting of its position.

In these machines, the arrangement of the tools and of the control stations has developed with time, as the techniques for tamping and displacement of the track have been refined and the demands of the users have become more severe.

On the first tampers which assured the above-indicated functions, the tools were arranged in the front of the machine below an overhung bracket. A control station for these tools and a driving station were arranged in a cab located to the rear of the tools and providing a view of them as well as of the track towards the front of the machine. A station for the setting and posting of displacement values was arranged on the outside of the machine near the displacement tools so that the operator in charge of that station could easily see certain prescribed values entered on the track and post them before the displacement tools arrived at their level.

These machines had the drawback of not permitting substantial displacements of the track, either vertically or laterally, without becoming unbalanced, due to the overhung position of the tools.

Lateral supports on the ballast of the shoulders and buttressing devices employing an articulated beam braced by jacks and supported by a pony truck on the rails of the track in front of the machine were proposed, in succession, as solutions to this problem and gave satisfaction. However, on the other hand, the lateral supports were inconvenient to handle and had a tendency to break up the shoulders, and the buttress devices did not permit rapid advance upon travel to the work site without the danger of derailment of the pony truck.

On the present machines of the type covered by the present invention, the location of the tools between the two rolling supports permits greater displacements of the track without any of the drawbacks mentioned and therefore provides a better solution to this problem. Some of these tampers are equipped with a cab arranged behind the tools so as to assure visibility of the latter from their control station. On these tampers, in addition to this control station, a driving station and possibly a station for verification of the displacements of the track which are obtained upon tamping are installed in said rear cab, but the station for the setting and posting of prescribed values of displacement is still located in the vicinity of the displacement tools and on the outside of the machine, for the reasons already indicated.

These tampers are satisfactory but they nevertheless require a special relatively narrow structure of the rolling chassis from the place of the setting and posting station up to the front of the machine in order to assure sufficient visibility for the operators.

Furthermore, certain railway systems no longer will accept having this station on the outside and demand good visibility over the track in both directions for the driving of the machine to the work site. It is a fact that on the so-called "heavy" tampers which have a plurality of tamping head, the cab, which is thus arranged at the rear, is too far from the front of the machine to assure good visibility in that direction.

In order to satisfy this demand, the manufacturers have been forced to install on tampers of this type which are to work on these systems a second cab arranged at the front of the machine in order to install there a second driving station and the station for the setting and posting of the displacement values, while the first driving station, the control station for the tools and possibly the station for verification of the displacement values obtained after tamping remain in the rear cab.

This last-mentioned solution, which fully satisfies the aforementioned demands, is however expensive since it requires the installing of two cabs with their entrance and air-conditioning units as well as the installation of means of communication which are indispensable between the two teams of operators.

Furthermore, the rearward position of the station for the control of the tools as seen in the direction of advance when working, does not provide optimal view of the displacement tools, they being partially screened by the tamping tools which are located between them and the cab.

In order to improve this visibility, certain manufacturers have been led to install a third cab used solely for the control station 9 for the tools and arranged in front of the tools, which solution while technically adequate is even more expensive.

The tamper in accordance with the invention, as characterized in claim 1, provides a different solution for the above-indicated problems relating to visibility of the track and the tools without requiring the installing of several cabs and the restraints resulting therefrom and making it possible, by a completely different design of the machine, to centralize the control posts in a single cab and in optimal positions.

The accompanying drawing illustrates the development of the prior art and shows by way of example one embodiment of the object of the invention.

FIGS. 1, 2, 3 and 4 are views in elevation of the four known types of tamper.

Figure 4:
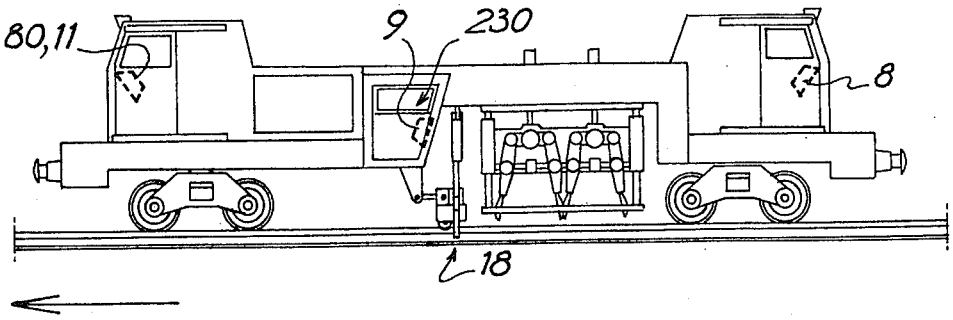
FIG. - 4 PRIOR ART

In these six figures, the direction of advance of the machine upon working is indicated by the arrow.

The tamper shown in FIG. 1 is of the type of the original tamper-leveler-straightener machines mentioned above which simultaneously assure the tamping, leveling and straightening of the railway tracks.

There can be noted the arrangement of the tamping (1) and displacement (2) tools for the track (3) in front of the two axles (4) and (5) of the rolling chassis (6) of the machine, which tools were fastened overhung beneath a bracket (7) forming an extension of said chassis. The driving station (8) and the control station (9) for the tools are shown in dashed line within the cab (10) of this machine and the setting and posting station (11) is shown in solid lines on the outside, in front of the tamping tools 1. An inner window (12) provided a view of all of the tools from the control station (9). The power station (13) for this tamper was installed behind the second axle (5) in order better to balance the machine.

The tamper shown in FIG. 2 is of the present type which has also been mentioned which has tools for the tamping (1) and displacement (2) of the track (3) arranged between the two axles (4) and (5) below a bridge part (14) of its rolling chassis in order to permit larger displacements of the track without unbalancing the machine. As in the case of the preceding tamper, a driving station (8) and a control station (9) are installed in a cab (16) behind the tools, a window (12) providing a view of the tools, and the setting and posting station (11) is installed on the outside, in front of said tools. On this tamper, as explained previously, the front part (150) of the rolling chassis (15) is specifically made narrow in order to assure sufficient visibility for the operators towards the front.

The tamper shown in FIG. 3 is of the type of the present so-called "heavy" tampers which have also been mentioned. It has double-head tamping tools (17) and displacement tools (18) arranged between two trucks (19) and (20) below a bridge-shaped part (21) of its rolling chassis (22). It is on this type of tamper that, in addition to a rear cab (23) equipped with a driving station (8) and a control station (9) for the tools, there is installed a second cab (24), at the front of the machine, within which there are a second driving station (80) and the setting and posting station (11). The purpose of this is to assure the driver completely free visibility of the track, both in front and towards the rear of the machine, for travel to the work site as required by certain railway systems and in order to house the operator. The power plant (13) is installed on the rolling chassis (22) to the rear of the second cab (24) of this tamper.

The tamper shown in FIG. 4 is of the last-mentioned type in which a third cab (230) is arranged in front of the assembly of tools, to which cab there is transferred the control station (9) for the tools in order to assure from this station better visibility of the displacement tools (18), which is advantageous in particular for turn-out tampers.

Figure 5:
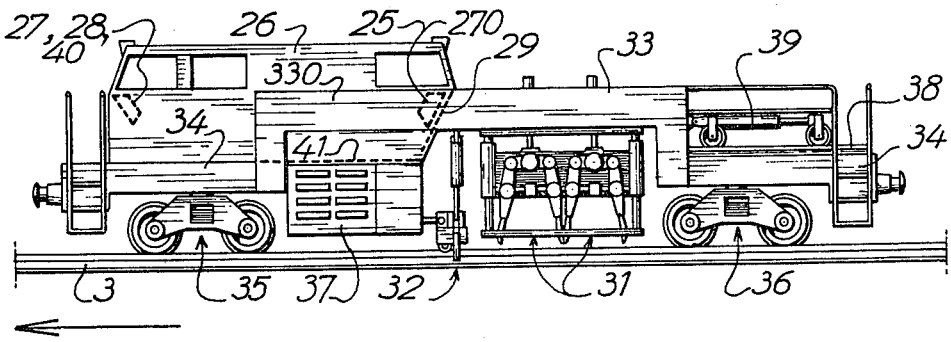
FIG. 5 is a view in elevation of the embodiment given by way of example.

The tamper in accordance with the invention, one embodiment of which of the so-called "heavy" type is shown in FIG. 5, has, in the same manner as the two preceding ones, double-head tamping tools (31) and displacement tools (32) which are fastened below a bridge-shaped part (33) of its rolling chassis (34) and are arranged between two trucks (35) and (36). On the other hand, it has only a single cab (26) in which all the work stations are contained.

This cab (26) is installed on the rolling chassis (34) at the front of the machine with reference to the direction of advance during work indicated by the arrow and is extended towards the rear up to substantially above the displacement tools (32) where it has an inner window (29) providing a view of these tools as well as of the tamping tools (31).

The bridge-shaped part (33) of the rolling chassis has an extension (330) which extends along the rear part of the cab (26) and the power station (37) of this tamper is arranged below this extension, in this case below the floor of the cab (26) indicated by a dashed line (41). As a matter of fact, the rear of the cab (26) is located in this case in an inner cutout of the extension (330) of the bridge-shaped part, between the side girders of the latter, but any other system of inter-penetration which frees passage from the front to the rear in the cab can be employed.

In this way, in this single cab (26) there can be installed at their optimal locations:

at the front, a driving station (27), a station for the setting and posting of prescribed displacement values (28) and possibly a station (40) for measuring and verifying the actual values of displacement obtained after the tamping, when the tamper is equipped with such a device;

at the rear, a control station (25) for the tools, providing a view of them through the window (29) and a second driving station (270) which provides a view of the track towards the rear.

The driver can thus drive the machine to the work site successively in one direction and the other without getting down from the machine in order to go from one cab to the other, as is necessary on the present two-cab machines.

Furthermore, two operators alone can thus assure all the control functions:

A tamper operator assuring the supervision and control of the tools as well as the driving of the machine when working and upon moving to the site at the control station (25) and at one of the two driving station (27) or (270).

A verifier-operator assuring the posting of the prescribed displacement values at the posting station (28). which values he can set as a function of the values obtained after tamping, which he can read at the verification station (40).

The rear part of the rolling chassis (34), which is thus freed of any superstructure, is arranged as a loading platform (38) and can receive, as shown, a measurement truck (39) forming part of a device for measuring the displacements of the track obtained after tamping, when the tamper is equipped with such a device, and which, when working, is coupled to the rear of the machine.

Developed in this manner, the tamper in accordance with the invention makes it possible economically to satisfy the demands of the railway systems, both at the stage of its manufacture and with respect to its maintenance and operation, due to the centralizing of the functions in a single elongated cab.

Figure 6:
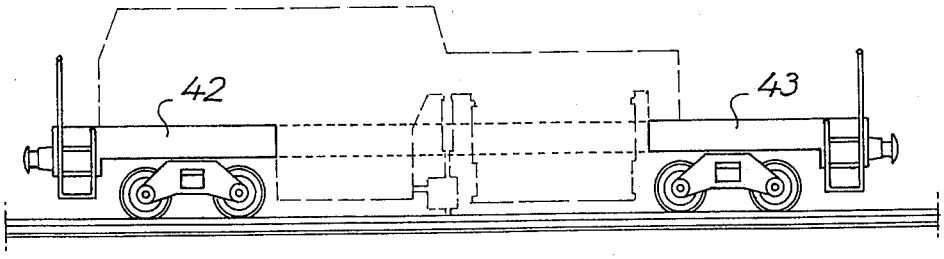
FIG. 6 shows a variant of a structural detail thereof.

For this same purpose of economy, and in particular in the case of the construction of a tamper intended to be moved to the working site by inclusion within a normal railway train, both the front and rear parts of the rolling chassis (34) which are connected together by the bridge part (33-330) can be formed of the two corresponding parts (42 and 43) of a standard mass-produced flatcar, shown in FIG. 6, which has been cut between its two rolling supports.

What is claimed is:

1. A railway track tamping machine comprising:

(a) a rolling chassis having a bridge-shaped portion and two rolling supports;

(b) tool means for the displacement of the track, said tool means arranged between said rolling supports beneath said bridge-shaped portion;

(c) tool means for the tamping of the track, said tool means also arranged between said rolling supports beneath said bridge-shaped portion, said tamping tool means being located behind said displacement tool means with respect to the working direction of advance of the machine;

(d) a single cab means arranged at the front of said rolling chassis with respect to said working direction of advance, said single front cab means extended towards the rear up to at least above said displacement tool means for affording view over said displacement tool means and said tamping tool means;

(e) a device for establishing and verifying the amplitude of the displacements of the track which are obtained at the level of said displacement tool means;

(f) an extension formed on said bridge-shaped portion of the rolling chassis, said extension extended at least along the rear part of said single front cab means;

(g) power station means arranged below said extension;

(h) a control station means for the movements of said tamping and displacement tool means, said control station means arranged in said single front cab means;

(i) a prescribed value setting and posting station means for said track displacement amplitude establishing and verifying device, said station means arranged in said single front cab means; and (j) driving station means also arranged in said single front cab means.

2. A tamper according to claim 1, wherein said rolling chassis comprises a rear part following its bridge-shaped portion, and wherein said rear part is arranged as a loading platform.

3. A tamper according to claim 1 or 2, adapted to be displaced upon travel to a work site by inclusion in a normal railway train, wherein said rolling chassis comprises a front part and a rear part connected by said bridge-shaped portion, and wherein said front and rear parts are formed of two corresponding parts of an ordinary standard flatcar cut out between its two rolling supports.

4. A tamper according to claim 1, further comprising a device for measuring and verifying the actual displacements of the track obtained after tamping and a station for verifying the measured values, wherein said verification station is also arranged in said single front cab means in the vicinity of said prescribed values setting and posting station means.

5. A tamper according to claim 4, in which the device for measuring and verifying the actual displacements of the track obtained after tamping comprises at least one measurement truck which is coupled to the rear of the rolling chassis during work, wherein said rolling chassis has a rear part following its bridge-shaped portion, wherein said rear part is arranged as a loading platform, and wherein said measurement truck is placed on the loading platform when not in use.

6. A tamper according to claim 2, equipped with a device for measuring and verifying the actual displacement of the track which are obtained after tamping comprising at least one measurement truck which is coupled to the rear of the rolling chassis during work, wherein the measurement truck is placed on said loading platform when not in use.

* * * * *